US010435272B2

(12) United States Patent
Zhang

(10) Patent No.: US 10,435,272 B2
(45) Date of Patent: Oct. 8, 2019

(54) PREFERRED ELEVATOR SELECTION WITH DISPATCHING INFORMATION USING MOBILE PHONE APP

(71) Applicant: Otis Elevator Company, Farmington, CT (US)

(72) Inventor: Jinglong Zhang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 81 days.

(21) Appl. No.: 15/451,859

(22) Filed: Mar. 7, 2017

(65) Prior Publication Data

US 2017/0260023 A1 Sep. 14, 2017

(30) Foreign Application Priority Data

Mar. 9, 2016 (CN) ..... 2016 1 0131625

(51) Int. Cl.

| | |
|---|---|
| ***B66B 1/46*** | (2006.01) |
| ***B66B 1/24*** | (2006.01) |
| ***B66B 3/00*** | (2006.01) |

(52) U.S. Cl.

CPC ..... *B66B 1/468* (2013.01); *B66B 1/2408* (2013.01); *B66B 3/002* (2013.01); *B66B 2201/4615* (2013.01); *B66B 2201/4653* (2013.01)

(58) Field of Classification Search

CPC ..... B66B 1/468; B66B 1/2408; B66B 3/002

(Continued)

(56) References Cited

U.S. PATENT DOCUMENTS 4,852,696 A * 8/1989 Fukuda ..... B66B 3/00 187/392
4,924,416 A * 5/1990 Sasao ..... B66B 1/3476 187/392

(Continued)

FOREIGN PATENT DOCUMENTS

GB 2240196 A * 7/1991 ..... B66B 1/18
JP 2012056697 A 3/2012

(Continued)

OTHER PUBLICATIONS

European Search Report for application EP 17159976.4, dated Jul. 13, 2017, 9 pages.

(Continued)

*Primary Examiner* — David S Warren
(74) *Attorney, Agent, or Firm* — Cantor Colburn LLP

(57) ABSTRACT

The present invention provides an elevator-calling control apparatus, an elevator-calling control system and an elevator-calling control method thereof, and belongs to the field of elevator control technologies. In an elevator-calling control process, the following steps are included: inputting an elevator-calling command; displaying elevator running state information and estimated time of arrival information of several elevators in a corresponding elevator group for a passenger to make reference, wherein the elevator running state information at least includes information that reflects a current crowding degree of the elevator; and selecting an elevator from the several elevators as the elevator that the passenger determines to take. The elevator-calling control of the present invention may facilitate a passenger to actively select an elevator that the passenger determines to take, which has good user elevator calling and taking experience and enhances the running efficiency of the elevator.

27 Claims, 3 Drawing Sheets

(58) Field of Classification Search
USPC ..... 187/382
See application file for complete search history.

(56) References Cited

U.S. PATENT DOCUMENTS

| | | | | |
|---|---|---|---|---|
| 5,022,497 | A * | 6/1991 | Thanagavelu | B66B 1/2458 187/382 |
| 5,298,695 | A * | 3/1994 | Bahjat | B66B 1/285 187/295 |
| 5,329,076 | A * | 7/1994 | Kameli | B66B 1/2408 187/383 |
| 5,345,049 | A * | 9/1994 | Bahjat | B66B 1/2458 187/382 |
| 5,625,176 | A * | 4/1997 | Davis | B66B 1/2458 187/387 |
| 7,377,364 | B2 | 5/2008 | Tyni | |
| 7,552,802 | B2 * | 6/2009 | Hirade | B66B 1/2458 187/383 |
| 8,132,652 | B2 | 3/2012 | Hakala et al. | |
| 8,348,021 | B2 | 1/2013 | Finschi | |
| 8,387,756 | B2 | 3/2013 | Laihanen et al. | |
| 9,481,548 | B2 * | 11/2016 | Siddiqui | B66B 1/2416 |
| 9,978,020 | B1 * | 5/2018 | Gambetta | G06N 99/002 |
| 2010/0116596 | A1 * | 5/2010 | Mitsuru | B66B 1/3476 187/392 |
| 2011/0056772 | A1 | 3/2011 | Stanley et al. | |
| 2011/0272221 | A1 * | 11/2011 | Iwata | B66B 5/021 187/384 |
| 2011/0308891 | A1 | 12/2011 | Friedli | |
| 2012/0048655 | A1 * | 3/2012 | Hsu | B66B 1/468 187/247 |
| 2012/0146918 | A1 | 6/2012 | Kreiner et al. | |
| 2013/0168190 | A1 * | 7/2013 | Christy | B66B 1/2408 187/247 |
| 2014/0041968 | A1 | 2/2014 | Tokura | |
| 2014/0151160 | A1 | 6/2014 | Joyce et al. | |
| 2015/0368067 | A1 | 12/2015 | Tang | |
| 2017/0260023 | A1 * | 9/2017 | Zhang | B66B 1/2408 |
| 2018/0016116 | A1 * | 1/2018 | Hiltunen | B66B 1/468 |
| 2018/0086595 | A1 * | 3/2018 | Guillot | B66B 1/52 |

FOREIGN PATENT DOCUMENTS

| | | | |
|---|---|---|---|
| JP | 2013001498 | A | 1/2013 |
| JP | 2015030613 | A | 2/2015 |
| WO | 2011102654 | A2 | 8/2011 |
| WO | 2012093985 | A1 | 7/2012 |
| WO | 2013033879 | A1 | 3/2013 |

OTHER PUBLICATIONS

KONE, "KONE RemoteCall Smartphone Application for KONE Polaris 900 Destination Control System", available at: http://cdn.kone.com/www.kone.tw/Images/kone-remotecall-factsheet.pdf?v=1, 2013, 2pgs.

Robarts, Stu "myPORT app unlocks doors and calls elevators for you", NewsAtlas, available at: http://newatlas.com/myport-building-access-app/35084/, Dec. 5, 2014, 5pgs.

* cited by examiner

PREFERRED ELEVATOR SELECTION WITH DISPATCHING INFORMATION USING MOBILE PHONE APP

PRIORITY

This application claims priority to Chinese Patent Application No. CN201610131625.0, filed 9 Mar. 2016, and all the benefits accruing therefrom under 35 U.S.C. § 119, the contents of which in its entirety are herein incorporated by reference.

TECHNICAL FIELD

The present invention belongs to the field of elevator control technologies, relates to an elevator-calling operation of an elevator, and in particular, to an elevator-calling control method, apparatus and system of an elevator that a passenger can actively select to take.

BACKGROUND ART

When a passenger needs to take an elevator, he/she needs to perform an elevator-calling operation at first, and an elevator dispatching system would, based on an instruction inputted in the elevator-calling operation, conduct dispatching control on a controlled elevator group, thus fixedly assigning a corresponding elevator to run to a starting floor of the elevator-calling operation of the passenger for the passenger to take.

The current elevator-calling way and elevator dispatching method can only assign a single and fixed elevator to the passenger, and the passenger is totally unable to actively select an elevator according to his/her own preference and other factors.

Afterwards, in an actual elevator taking process, the following situations may exist: when the elevator fixedly assigned arrives at the starting floor where the passenger is, it is relatively crowed in the elevator car, and the passenger is unwilling to take the crowed elevator, and selects to continue the elevator-calling and waits, in this way, the passenger's time is wasted and the running efficiency of the elevator is also influenced; or the passenger finds that the waiting time is very long, which not only wastes the passenger's waiting time but also may cause delay to the business of the passenger; or because the passenger carries a larger object, when the fixedly assigned elevator arrives at the starting floor where the passenger is, the object cannot be accommodated due to the crowding degree in the elevator car, so the passenger has to continue elevator-calling and wait for the next elevator. Therefore, the passenger has relatively poor experience in terms of the existing elevator-calling way.

SUMMARY OF THE INVENTION

An objective of the present invention is to realize that a passenger can actively select a corresponding elevator in an elevator-calling process.

A further objective of the present invention is to improve elevator calling and elevator taking experience of a passenger.

In order to achieve the foregoing objectives or other objectives, the present invention provides the following technical solutions.

According to one aspect of the present invention, an elevator-calling control method is provided, including the steps of:

inputting an elevator-calling command;

displaying elevator running state information and estimated time of arrival information of several elevators in a corresponding elevator group for a passenger to make reference, wherein the elevator running state information at least includes information that reflects a current crowding degree of the elevator; and selecting an elevator from the several elevators as the elevator that the passenger determines to take.

According to the elevator-calling control method in an embodiment of the present invention, wherein the elevator-calling command includes a starting floor and a target floor.

Specifically, the information that reflects a current crowding degree of the elevator includes current load information of an elevator car.

According to the elevator-calling control method in another embodiment of the present invention, wherein, in the displaying step, estimated information of the crowding degree of the elevator when the elevator runs to the starting floor is further displayed.

According to the elevator-calling control method in a yet another embodiment of the present invention, wherein, in the displaying step, estimated travel time information of the elevator when the elevator runs from the starting floor to the target floor is further displayed.

According to the elevator-calling control method in a further embodiment of the present invention, wherein, in the displaying step, attribute information of each elevator is further displayed.

In the elevator-calling control method according to any of the preceding embodiments, the several elevators are elevators in the elevator group which are determined to be available for the passenger to select and take.

In the elevator-calling control method according to any of the preceding embodiments, the elevator-calling control method is completed in an area outside an elevator waiting hall of the starting floor.

According to another aspect of the present invention, an elevator-calling control apparatus, including:

an elevator calling module configured to input an elevator-calling command;

an elevator information display module configured to display elevator running state information and estimated time of arrival information of several elevators in a corresponding elevator group for a passenger to make reference, wherein the elevator running state information at least includes information that reflects a current crowding degree of the elevator; and an elevator selecting module configured to select an elevator from the several elevators as the elevator that the passenger determines to take.

According to the elevator-calling control apparatus in an embodiment of the present invention, wherein the elevator-calling command includes a starting floor and a target floor.

Specifically, the information that reflects the current crowding degree of the elevator includes current load information of an elevator car.

According to the elevator-calling control apparatus in another embodiment of the present invention, wherein the elevator information display module is further configured to display estimated information of the crowding degree of the elevator when the elevator runs to the starting floor.

According to the elevator-calling control apparatus in a yet another embodiment of the present invention, wherein the elevator information display module is further configured to display estimated travel time information of the elevator when the elevator runs from the starting floor to the target floor.

According to the elevator-calling control apparatus in a further embodiment of the present invention, wherein the elevator information display module is further configured to display attribute information of each elevator.

In the elevator-calling control apparatus according to any of the preceding embodiments, the several elevators are elevators in the elevator group which are determined to be available for the passenger to select and take.

In the elevator-calling control apparatus according to any of the preceding embodiments, the elevator-calling control apparatus is configured to be a mobile intelligent terminal capable of completing elevator-calling control in an area outside an elevator waiting hall of the starting floor.

Specifically, the mobile intelligent terminal is a smart phone or a palm computer, which is loaded with an application (APP) at least having the elevator calling module, the elevator information display module and the elevator selecting module.

According to a further aspect of the present invention, an elevator-calling control system, including an elevator-calling control terminal and an elevator control apparatus, wherein the elevator control apparatus includes an elevator group-control dispatching control component and multiple single elevator running control components coupled to the elevator group-control dispatching control component; wherein:

the elevator-calling control terminal is at least provided with:

an elevator-calling component configured to input an elevator-calling command by a passenger, an elevator information display component configured to display elevator running state information and estimated time of arrival information of several elevators in a corresponding elevator group, and an elevator selecting component configured to select an elevator from the several elevators as the elevator that the passenger determines to take;

the elevator group-control dispatching control component of the elevator control apparatus is configured to receive the elevator-calling command and, based on the elevator-calling command, feedback the elevator running state information and the estimated time of arrival information of the several elevators in the corresponding elevator group to the elevator-calling control terminal; and the elevator control apparatus is further configured to receive an instruction of selecting an elevator in the elevator selecting component, and send the instruction to the corresponding single elevator running control component.

According to the elevator-calling control system in an embodiment of the present invention, wherein the elevator-calling command includes a starting floor and a target floor.

Specifically, information reflecting a current crowding degree of the elevator includes current load information of an elevator car.

According to the elevator-calling control system in another embodiment of the present invention, wherein the elevator information display component is further configured to display estimated information of the crowding degree of the elevator when the elevator runs to the starting floor.

According to the elevator-calling control system in a yet another embodiment of the present invention, wherein the elevator information display component is further configured to display estimated travel time information of the elevator when the elevator runs from the starting floor to the target floor.

According to the elevator-calling control system in a further embodiment of the present invention, wherein the elevator information display component is further configured to display attribute information of each elevator.

In the elevator-calling control system according to any of the preceding embodiments, the elevator group-control dispatching control component of the elevator control apparatus is further configured to determine, at least based on the elevator-calling command, elevators in the elevator group which are available for the passenger to select and take as the several elevators.

In the elevator-calling control system according to any of the preceding embodiments, the elevator-calling control terminal is configured to be a mobile intelligent terminal capable of completing elevator-calling control in an area outside an elevator waiting hall of the starting floor.

Specifically, the mobile intelligent terminal is a smart phone or a palm computer, which is loaded with an application (APP) for implementing at least the elevator-calling component, the elevator information display component and the elevator selecting component.

According to an aspect of the present invention, an elevator-calling control method of the elevator-calling system described above, including the steps of:

inputting an elevator-calling command from the elevator calling module of the elevator-calling control terminal;

collecting or calculating, based on the elevator-calling command, the elevator running state information and the estimated time of arrival information of the several elevators in the corresponding elevator group;

displaying, by the elevator-calling control terminal, the elevator running state information and the estimated time of arrival information of the several elevators in the corresponding elevator group for the passenger to make reference;

selecting an elevator from the elevator-calling control terminal as the elevator that the passenger determines to take; and sending an instruction of selecting an elevator to the corresponding single elevator running control component to control the running of the elevator.

According to the elevator-calling control method in an embodiment of the present invention, wherein the elevator-calling command includes a starting floor and a target floor.

Specifically, information that reflects a current crowding degree of the elevator includes current load information of an elevator car.

According to the elevator-calling control method in another embodiment of the present invention, wherein, in the displaying step, estimated information of a crowding degree of the elevator when the elevator runs to the starting floor is further displayed.

According to the elevator-calling control method in a yet another embodiment of the present invention, wherein, in the displaying step, estimated travel time information of the elevator when the elevator runs from the starting floor to the target floor is further displayed.

According to the elevator-calling control method in a further embodiment of the present invention, wherein, in the displaying step, attribute information of each elevator is further displayed.

In the elevator-calling control method according to any of the preceding embodiments, the following step is further included:

determining, at least based on the elevator-calling command, elevators in the elevator group which are available for the passenger to select and take as the several elevators.

In the elevator-calling control method according to any of the preceding embodiments, the elevator-calling control terminal is a mobile intelligent terminal.

Specifically, the step of inputting an elevator-calling command, the displaying step and the elevator selecting step are completed in an area outside an elevator waiting hall of the starting floor.

The present invention has the following technical effects: the elevator-calling control of the present invention can realize at least displaying current crowding degree information and estimated time of arrival information on an elevator-calling control terminal, and facilitate a passenger to actively select an elevator that the passenger determines to take. Therefore, user elevator calling experience and taking experience are good; moreover, a large quantity of elevator dispatching unreasonable or not accepted by the passenger is reduced, and the running efficiency of the elevator is improved greatly.

BRIEF DESCRIPTION OF THE DRAWINGS

In the following detailed description with reference to the accompanying drawings, the foregoing and other objectives and advantages of the present invention would be more complete and clearer, wherein identical or similar elements are indicated with identical reference signs.

DETAILED DESCRIPTION

The present invention is described below with reference to the flowchart descriptions of the method, system, and apparatus according to embodiments of the present invention and/or block diagrams and/or flowcharts. It should be understood that each block in the flowchart descriptions and/or block diagrams and a combination of the flowchart descriptions and/or block diagrams may be implemented by, but not limited to, computer program instructions, for example, they may also be implemented by corresponding hardware (e.g., a FPGA or DSP or the like). In the case of implementation based on the computer program instructions, these computer program instructions may be provided for a general-purpose computer, a special-purpose computer, an embedded processor, or a processor of another programmable data processing device to generate a machine, so that the instructions executed by a computer or a processor of another programmable data processing device create a member for implementing a specified function/operation in the flowcharts and/or blocks and/or one or more flowcharts.

It should be noted that these computer program instructions may also be stored in a computer readable memory that can instruct the computer or other programmable data processing devices to function in a particular manner, such that the instructions stored in the computer readable memory generate a member that includes an instruction of implementing a specified function/operation in the flowcharts and/or blocks and/or one or more flowcharts.

It should also be noted that these computer program instructions may also be loaded onto a computer or another programmable data processor, such that a series of operating steps are performed on the computer or another computer programmable processor, thereby generating computer-implemented processing. Therefore, the instructions executed on the computer or another programmable data processor provide steps for implementing a specified function or operation in the flowchart and/or one or more blocks in the block diagrams. It should be further nodded that, in some alternative implementations, the functions/operations shown in the blocks may not take place according to the order shown in the flowcharts. For example, two blocks shown sequentially may be basically performed at the same time or the blocks may sometimes be performed according to a reverse order, which specifically depends on the functions/operations involved.

Figure 1:
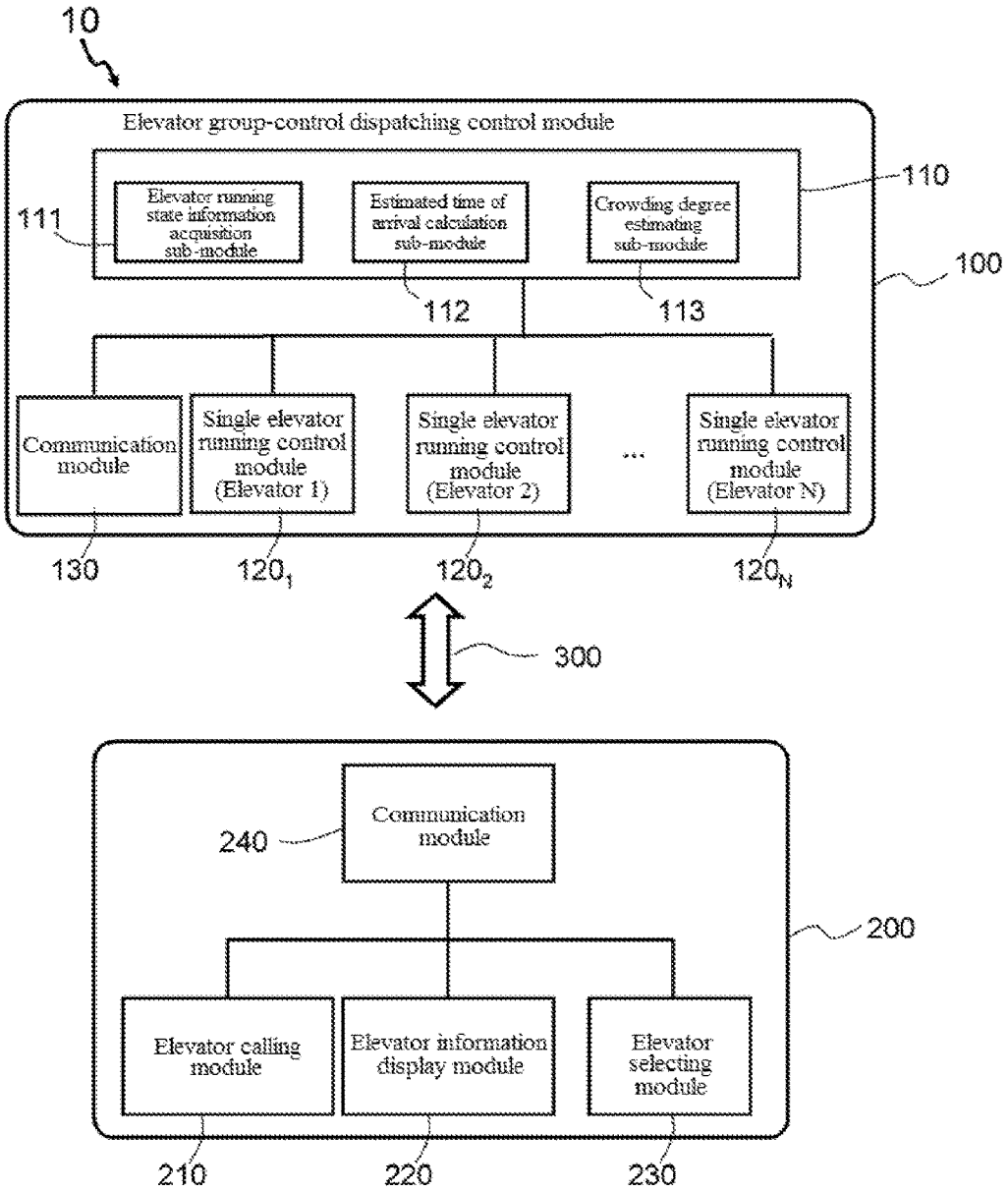
FIG. 1 is a schematic block diagram of a module structure of an elevator-calling control system according to an embodiment of the present invention.

FIG. 1 illustrates a schematic block diagram of a module structure of an elevator-calling control system according to an embodiment of the present invention. In this embodiment, the elevator-calling control system 10 includes an elevator control apparatus 100 and an elevator-calling control apparatus 200, wherein the elevator control apparatus 100 is correspondingly disposed at an elevator end, and the elevator-calling control apparatus 200 is correspondingly disposed at a passenger end, to facilitate the passenger to operate; therefore, the elevator-calling control apparatus 200 may also be provided in the form of a mobile terminal, which is easy to carry and facilitates performing an elevator-calling control operation remotely. In this way, the elevator-calling control apparatus 200 may also be referred to as an elevator-calling control terminal, which may be implemented through a mobile intelligent terminal (e.g., a smart phone).

FIG. 1 also illustrates a block diagram of a module structure of the elevator-calling control apparatus 200 according to an embodiment, which mainly includes: an elevator calling module 210, an elevator information display module 220 and an elevator selecting module 230. To implement communication with the elevator control apparatus 100 at the remote end, a communication module 240 is further disposed in the elevator-calling control apparatus 200. The elevator calling module 210 is configured to input an elevator-calling command, for example, a starting floor (i.e., the floor at which a passenger takes and enters an elevator car) and a target floor (i.e., the floor at which the passenger arrives) are input, and in other embodiments, the input elevator-calling command may also only include a starting floor and information about "up" or "down".

Correspondingly, a communication module 130 is also disposed in the elevator control apparatus 100, the communication module 130 and the communication module 340 may specifically be, for example, but not limited to, 3G/4G transceivers, and mutual sending and receiving of information can be implemented between them. In this way, wireless communication 300 can be implemented between the elevator control apparatus 100 and the elevator-calling control apparatus 200.

It should be understood that the above example only gives a schematic diagram of interaction between the elevator-calling control apparatus 200 and the elevator control apparatus 100. In an application example, each passenger may carry one elevator-calling control apparatus 200, and multiple elevator-calling control apparatuses 200 may conduct wireless communication interaction with the elevator control apparatus 100 respectively.

The elevator control apparatus 100 may be used to perform group control management on an elevator group consisting of multiple elevators (e.g., 1 to N elevators, N being greater than or equal to 2). The N elevators are disposed in the same building and can be dispatched to transfer passengers. Therefore, corresponding to each elevator, a corresponding single elevator running control module 120 is provided, for example, single elevator running control modules 1201, 1202 . . . to 120N. The single elevator running control modules 1201, 1202 . . . to 120N may be connected through an elevator bus, and may be connected to an elevator group-control dispatching control module 110 of the elevator control apparatus 100 at the same time. The single elevator running control modules 1201, 1202 . . . to 120N may run according to a dispatching instruction issued by the elevator group-control dispatching control module 110.

In this embodiment, the elevator group-control dispatching control module 110 is provided with an elevator running state information acquisition sub-module 111, which may be configured to acquire elevator running state information at least including information that reflects a current crowding degree of the elevator, for example, current load information of an elevator car; through the load information (e.g., a load percentage, which may be calculated according to current load weight and full load weight), the crowding degree of the elevator may be reflected basically accurately. Therefore, in normal circumstances, a greater load percentage reflects that there are more passengers in the elevator car. The load information may be acquired through a weight sensor on the elevator car and sent up to the elevator group-control dispatching control module 110. However, it should be understood that the elevator running state information of the information that reflects the current crowding degree of the elevator is not limited to the load information, which, for example, may also be image information (acquired through an image sensor and sent up to the elevator control apparatus 100) in the elevator car.

The elevator group-control dispatching control module 110 is provided with an estimated time of arrival calculation sub-module 112, which may calculate Estimated Time of Arrival (ETA) information. Specifically, the ETA may be calculated according to the current floor position of the elevator car, the position of the starting floor, an elevator running average speed and other information; in other embodiments, the ETA may also be calculated in consideration of an elevator-calling request situation of another floor and/or historical statistics data and the like; the specific calculation manner or calculation principle of the ETA is not limitative.

Based on the elevator running state information acquisition sub-module 111 and the estimated time of arrival calculation sub-module 112, crowding degree information and ETA of each elevator in the elevator group can be obtained respectively, the information may be sent to the communication module 240 of the elevator-calling control apparatus 200 through the communication module 130, so that the information can be displayed on the elevator information display module 220 in real time, and the passenger carrying the elevator-calling control apparatus 200 can conveniently select and determine, based on the information, an elevator to be taken on the elevator selecting module 230. In this way, the passenger may actively select an elevator according to his/her own condition (e.g., whether he/she carries a large luggage), time margin, elevator taking preference and the like, instead of passively accepting a fixed elevator assigned by an elevator group control dispatching system, which greatly improves the passenger's elevator-calling experience, is conducive to improving the passenger's elevator-taking experience, also reduces a large quantity of elevator dispatching unreasonable or not accepted by the passenger, and greatly improves the running efficiency of the elevator.

As shown in FIG. 1, in this embodiment, the elevator group-control dispatching control module 110 is provided with a crowding degree estimating sub-module 113, which is configured to calculate corresponding crowding degree estimated information when each elevator runs to the starting floor, the crowding degree estimated information may be calculated based on an elevator-calling command input in the elevator car and the like, which may also be sent to the elevator-calling control apparatus 200 and displayed through the elevator information display module 220, and the passenger can further select to take an elevator based on the crowding degree estimated information.

It should be understood that, in other embodiments, the elevator group-control dispatching control module 110 may also acquire other information which is sent to the elevator-calling control apparatus 200 and displayed through the elevator information display module 220, for the passenger to make reference, and any elevator information helping the passenger to select and decide an elevator to be taken can be applied thereto.

In another embodiment, the elevator group-control dispatching control module 110 may also be provided with an estimated travel time calculation module (not shown), which is configured to calculate estimated travel time information of the elevator when the elevator runs from the starting floor to the target floor, and send the estimated travel time information to the elevator-calling control apparatus 200 and display the estimated travel time information through the elevator information display module 220 for the passenger to make reference.

In a yet another embodiment, the elevator control apparatus 100 may also acquire attribute information of each elevator in the elevator group, for example, whether the elevator is a sightseeing elevator, and send the attribute information to the elevator-calling control apparatus 200 and display the attribute information through the elevator information display module 220 for the passenger to make reference. For example, if the passenger learns that an elevator is a sightseeing elevator, he/she may select to take the elevator.

As shown in FIG. 1, an instruction of selecting an elevator in the elevator selecting module 230 may be sent to the corresponding single elevator running control module 120 of the elevator control apparatus 100 to control the running of the elevator, for example, if the elevator selecting module 230 selects Elevator 2, the instruction of selecting an elevator is sent to the single elevator running control module 1202, and the single elevator running control module 1202 may control the running of Elevator 2 based on the instruction, which also facilitates simplifying dispatching operation of the elevator group-control dispatching control module 110.

It should be noted that, in the above embodiment, when the passenger inputs an elevator-calling command or an instruction of selecting an elevator in the elevator-calling control apparatus 200, the passenger may be located at the starting floor to perform the input operation; however, the passenger may also be located at another floor to perform the input operation, and may also be located at a position away from an elevator waiting hall to perform the input operation. Therefore, based on the elevator-calling control apparatus 200 in the embodiment of the present invention, the passenger may also perform a remote elevator-calling operation conveniently, and the passenger may further make full use of a time period of the ETA to complete other matters.

Figure 2:
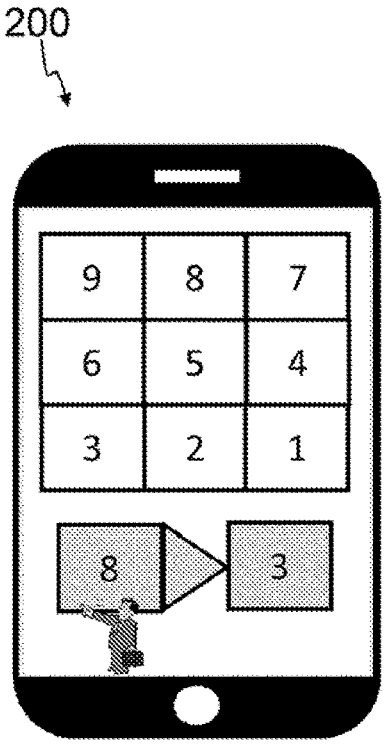
FIG. 2 is a schematic diagram of an operation interface when an elevator-calling control apparatus in the elevator-calling control system of the embodiment shown in FIG. 1 inputs an elevator-calling command.
Figure 3:
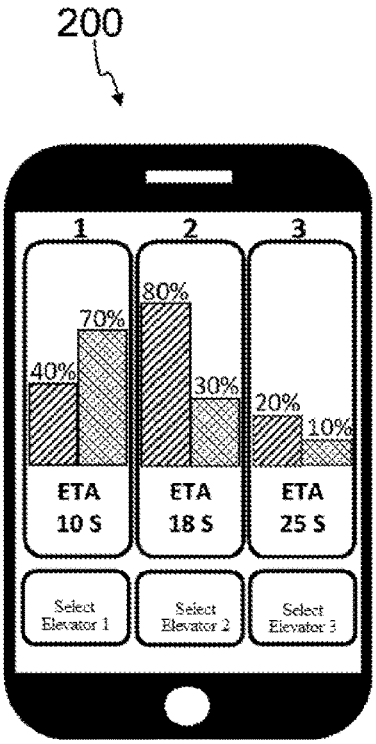
FIG. 3 is a schematic diagram of an operation interface when the elevator-calling control apparatus in the elevator-calling control system of the embodiment shown in FIG. 1 selects an elevator.
Figure 4:
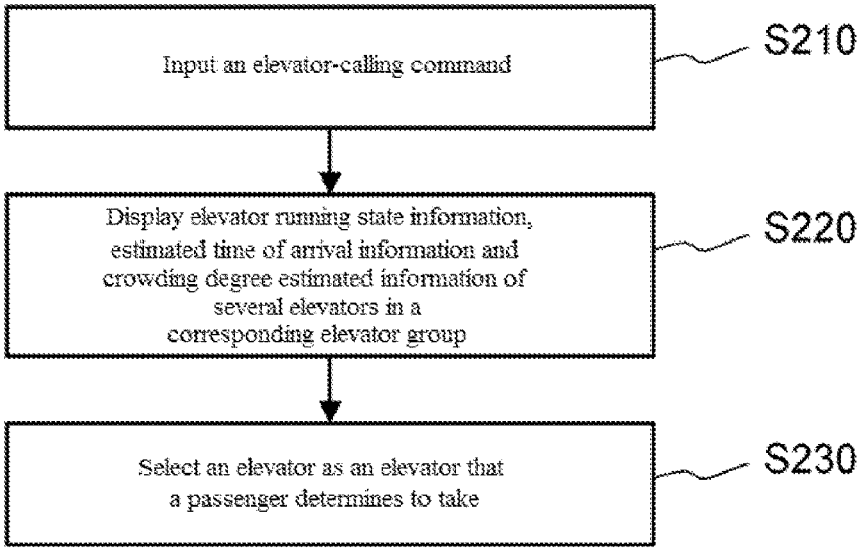
FIG. 4 is a schematic diagram of an elevator-calling control flow of the elevator-calling control apparatus in the elevator-calling control system of the embodiment shown in FIG. 1.

FIG. 2 illustrates a schematic diagram of an operation interface when an elevator-calling control apparatus in the elevator-calling control system of the embodiment shown in FIG. 1 inputs an elevator-calling command; FIG. 3 is a schematic diagram of an operation interface when the elevator-calling control apparatus in the elevator-calling control system of the embodiment shown in FIG. 1 selects an elevator; and FIG. 4 is a schematic diagram of an elevator-calling control flow of the elevator-calling control apparatus in the elevator-calling control system of the embodiment shown in FIG. 1. In this embodiment, the elevator-calling control apparatus 200 is implemented based on a computer program instruction, and is specifically implemented through an APP of a mobile intelligent terminal, by downloading a corresponding program package by a user and installing the program package in the mobile intelligent terminal; wherein the elevator calling module 210, the elevator information display module 220 and the elevator selecting module 230 of the elevator-calling control apparatus 200 are all disposed in the APP. The mobile intelligent terminal is a moveable terminal that has the capability of being connected to the Internet, according to or carrying an operating system, and can customize a variety of functions according to user requirements, which, for example, may be a smart phone, a palm computer, and the like.

The elevator-calling control method according to the embodiment of the present invention is illustrated below with reference to FIG. 1 to FIG. 4.

Firstly, in step S210, an elevator-calling command is input. The step is completed in the elevator calling module 210 of the elevator-calling control apparatus 200. As shown in FIG. 2, the passenger inputs a starting floor of "8" and a target floor of "3".

Further, in step S220, elevator running state information, estimated time of arrival information and crowding degree estimated information of several elevators in a corresponding elevator group are displayed. The step is completed in the elevator information display module 220 of the elevator-calling control apparatus 200. As shown in FIG. 3, content displayed in the elevator information display module 220 is illustrated. Elevator load information, ETA information and crowding degree estimated information of Elevators 1, 2 and 3 are displayed respectively, for example, in the display sub-module corresponding to Elevator 1, a histogram and data 40% are used to indicate current load information of the elevator, a histogram and data 70% are used to indicate load information when the elevator arrives at the starting floor, and ETA is 10S. In this way, the information is conveniently and intuitively presented before the passenger.

Further, in step S230, an elevator is selected as an elevator that the passenger determines to take. The step is completed in the elevator selecting module 230 of the elevator-calling control apparatus 200. As shown in FIG. 3, a select button is disposed on an operation interface of the elevator-calling control apparatus 200, each elevator is correspondingly provided with one select button, and pressing down or touching the corresponding button indicates that the corresponding elevator is selected to be taken.

So far, one elevator-calling control process of the passenger has been basically completed. The elevator-calling control method and the elevator-calling control apparatus in the above embodiments are implemented on the APP of the mobile intelligent terminal, in this way, the passenger not only can implement elevator-calling control remotely (i.e., elevator-calling control is performed outside an elevator waiting hall of the starting floor), and better experience brought about is: the passenger can select the most suitable elevator according to information displayed by the elevator information display module 220 and the current condition, for example, the passenger can select an elevator according to the time from the current position to the elevator waiting hall of the starting floor and the ETA information displayed by the elevator information display module 220, or the passenger can continuously arrange to process other things in an area (e.g., in an office) outside the elevator waiting hall of the starting floor according to the ETA information displayed by the elevator information display module 220, and so on. Therefore, while remote elevator calling is implemented, the passenger can effectively use the elevator-calling waiting time and the like, thus greatly improving the passenger's experience.

Figure 5:
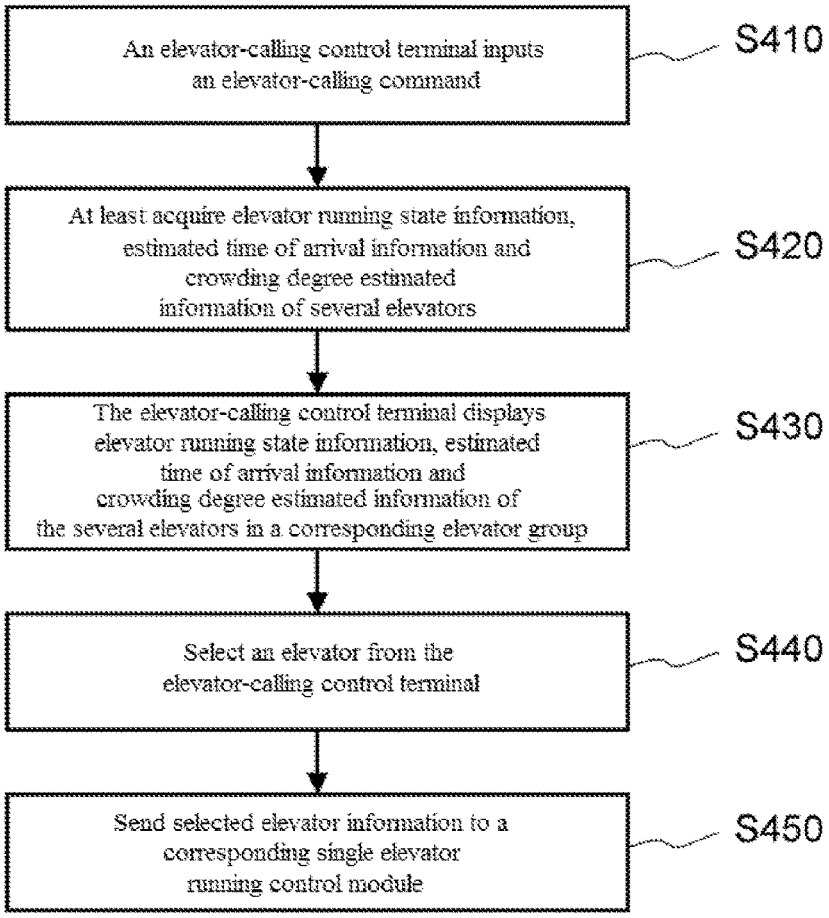
FIG. 5 is a schematic flowchart of an elevator-calling control method in the elevator-calling control system of the embodiment shown in FIG. 1.

FIG. 5 illustrates a schematic flowchart of an elevator-calling control method in the elevator-calling control system of the embodiment shown in FIG. 1. Illustration is provided in the following with reference to FIG. 1, FIG. 2, FIG. 3 and FIG. 5.

At first, in step S410, the elevator-calling control terminal 200 inputs an elevator-calling command, which may specifically input a starting floor and a target floor (as shown in FIG. 2) from the elevator calling module 210.

Further, in step S420, elevator running state information, ETA information and crowding degree estimated information of several elevators are at least acquired. As shown in FIG. 1, the elevator running state information, the ETA information and the crowding degree estimated information may be obtained respectively through the elevator running state information acquisition sub-module 111, the estimated time of arrival calculation sub-module 112 and the crowding degree estimating sub-module 113 disposed in the elevator group-control dispatching control module 110. Both the elevator running state information and the crowding degree estimated information may be represented through load information. It should be noted that, in other embodiments, the ETA may also be calculated through the estimated time of arrival calculation sub-module 112 disposed in the elevator-calling control apparatus.

Further, in step S430, the elevator-calling control terminal 200 displays the elevator running state information, the ETA information and the crowding degree estimated information of several elevators in the corresponding elevator group, and specifically, the elevator running state information, the ETA information and the crowding degree estimated information (as shown in FIG. 3) may be displayed by the elevator information display module 210 for the passenger to make reference. The example shown in FIG. 3 shows elevator running state information, ETA information and crowding degree estimated information of Elevators 1, 2 and 3 in the elevator group, in this embodiment, the Elevators 1, 2 and 3 are elevators available for the passenger to select to take (for example, Elevator 4 has been full and is unavailable for the passenger to select) calculated by dispatching control by the elevator group-control dispatching control module 110 based on the elevator-calling command, that is, several elevators in the step S420 are determined, and in this way, it is conducive to ensuring implementation of an upper dispatching algorithm of elevator group-control dispatching control, dispatching control over the elevator group may not be disordered, and the running efficiency of the elevator is ensured. In other embodiments, elevator running state information, ETA information and the like corresponding to all the elevators in the elevator group respectively may also be displayed, for the passenger to make reference.

Further, in step S440, an elevator is selected from the elevator-calling control terminal 200, specifically the elevator is selected from the elevator selecting module 230, as shown in FIG. 3, a select button is disposed on an operation interface of the elevator-calling control apparatus 200, each elevator is correspondingly provided with one select button, and pressing down or touching the corresponding button indicates that the corresponding elevator is selected to be taken, and an elevator selection instruction or selected elevator information is input.

Further, in step S450, the selected elevator information is sent to the corresponding single elevator running control module. In this step, the selection instruction may be sent to the single elevator running control module based on an elevator number in the selected elevator information, to control dispatching and running of the elevator.

So far, one elevator-calling control process of the elevator-calling control system has been basically completed.

It should be noted that the elevator control apparatus 100 in the elevator-calling control system 10 according to the embodiment of the present invention may also receive an elevator-calling command or instruction sent in a traditional way, and the elevator group-control dispatching control module 110 directly performs dispatching control over the elevator based on the elevator-calling command or instruction, to assign a fixed elevator for the passenger to take.

It should be understood that, when one member is "connected" or "coupled" to another member, it may be directly connected or coupled to another member or there may be an intermediate member.

The above examples mainly describe the elevator-calling control apparatus, the elevator-calling control system and the elevator-calling control method of the present invention. Although only some implementations of the present invention are described, those of ordinary skill in the art should understand that the present invention may be implemented in many other forms without departing from the purport and scope thereof, for example, the estimated time of arrival calculation sub-module 112 and/or the estimated travel time calculation module in the elevator group-control dispatching control module 110 are/is disposed in the elevator-calling control apparatus 200. Therefore, the examples and implementations illustrated are regarded as schematic instead of being limitative, and the present invention may cover various modifications and replacements without departing from the spirit and scope of the present invention defined by the appended claims.

What is claimed is:

1. An elevator-calling control method, comprising:

inputting an elevator-calling command;

displaying elevator running state information and estimated time of arrival information of several elevators in a corresponding elevator group for a passenger to make reference, wherein the elevator running state information at least comprises information that reflects a current crowding degree of the elevator; and selecting an elevator from the several elevators for the passenger in response to a passenger selection;

wherein the information that reflects the current crowding degree of the elevator comprises current load information of an elevator car;

wherein the displaying comprises displaying estimated information of the crowding degree of the elevator when the elevator arrives to a starting floor.

2. The elevator-calling control method of claim 1, wherein the elevator-calling command comprises the starting floor and a target floor.

3. The elevator-calling control method of claim 1, wherein the displaying comprises displaying estimated travel time information of the elevator when the elevator runs from the starting floor to the target floor.

4. The elevator-calling control method of claim 1, wherein the displaying comprises displaying attribute information of each elevator.

5. The elevator-calling control method of claim 1, wherein the several elevators are elevators in the elevator group which are determined to be available for the passenger to select and take.

6. The elevator-calling control method of claim 1, wherein the elevator-calling control method is completed in an area outside an elevator waiting hall of the starting floor.

7. An elevator-calling control apparatus, comprising:

an elevator calling module configured to input an elevator-calling command;

an elevator information display module configured to display elevator running state information and estimated time of arrival information of several elevators in a corresponding elevator group for a passenger to make reference, wherein the elevator running state information at least comprises information that reflects a current crowding degree of the elevator; and an elevator selecting module configured to select an elevator for the passenger in response to a passenger selection;

wherein the information that reflects the current crowding degree of the elevator comprises current load information of an elevator car;

wherein the elevator information display module is further configured to display estimated information of the crowding degree of the elevator when the elevator arrives at the a starting floor.

8. The elevator-calling control apparatus of claim 7, wherein the elevator-calling command comprises a starting floor and a target floor.

9. The elevator-calling control apparatus of claim 7, wherein the elevator information display module is further configured to display estimated travel time information of the elevator when the elevator runs from the starting floor to the target floor.

10. The elevator-calling control apparatus of claim 7, wherein the elevator information display module is further configured to display attribute information of each elevator.

11. The elevator-calling control apparatus of claim 7, wherein the several elevators are elevators in the elevator group which are determined to be available for the passenger to select and take.

12. The elevator-calling control apparatus of claim 7, wherein the elevator-calling control apparatus is configured to be a mobile intelligent terminal capable of completing elevator-calling control in an area outside an elevator waiting hall of the starting floor.

13. The elevator-calling control apparatus of claim 12, wherein the mobile intelligent terminal is a smart phone or a palm computer, which is loaded with an application at least having the elevator calling module, the elevator information display module and the elevator selecting module.

14. An elevator-calling control system, comprising an elevator-calling control terminal and an elevator control apparatus, wherein the elevator control apparatus comprises an elevator group-control dispatching control component and multiple single elevator running control components coupled to the elevator group-control dispatching control component; wherein:

the elevator-calling control terminal is at least provided with:

an elevator-calling component configured to input an elevator-calling command by a passenger, an elevator information display component configured to display elevator running state information and estimated time of arrival information of several elevators in a corresponding elevator group, wherein the elevator running state information at least comprises information that reflects a current crowding degree of the elevator; and an elevator selecting component configured to select an elevator from the several elevators as the elevator that the passenger determines to take;

the elevator group-control dispatching control component of the elevator control apparatus is configured to receive the elevator-calling command and, based on the elevator-calling command, feedback the elevator running state information and the estimated time of arrival information of the several elevators in the corresponding elevator group to the elevator-calling control terminal; and the elevator control apparatus is further configured to receive an instruction of selecting an elevator in the elevator selecting component, and send the instruction to the corresponding single elevator running control component;

wherein the information reflecting the current crowding degree of the elevator comprises current load information of the elevator car;

wherein the elevator information display component is further configured to display estimated information of the crowding degree of the elevator when the elevator runs to the starting floor.

15. The elevator-calling control system of claim 14, wherein the elevator-calling command comprises a starting floor and a target floor.

16. The elevator-calling control system of claim 14, wherein the elevator information display component is further configured to display estimated travel time information of the elevator when the elevator runs from the starting floor to the target floor.

17. The elevator-calling control system of claim 14, wherein the elevator information display component is further configured to display attribute information of each elevator.

18. The elevator-calling control system of claim 14, wherein the elevator group-control dispatching control component of the elevator control apparatus is further configured to determine, at least based on the elevator-calling command, elevators in the elevator group which are available for the passenger to select and take as the several elevators.

19. The elevator-calling control system of claim 14, wherein the elevator-calling control terminal is configured to be a mobile intelligent terminal capable of completing elevator-calling control in an area outside an elevator waiting hall of the starting floor.

20. The elevator-calling control system of claim 19, wherein the mobile intelligent terminal is a smart phone or a palm computer, which is loaded with an application for implementing at least the elevator-calling component, the elevator information display component and the elevator selecting component.

21. An elevator-calling control method of the elevator-calling system of claim 14, the method comprising:

inputting an elevator-calling command from the elevator calling module of the elevator-calling control terminal;

collecting or calculating, based on the elevator-calling command, the elevator running state information and the estimated time of arrival information of the several elevators in the corresponding elevator group;

displaying, by the elevator-calling control terminal, the elevator running state information and the estimated time of arrival information of the several elevators in the elevator group for the passenger to make reference;

selecting an elevator from the elevator-calling control terminal as the elevator that the passenger determines to take; and sending an instruction of selecting an elevator to the corresponding single elevator running control component to control the running of the elevator.

22. The elevator-calling control method of claim 21, wherein the elevator-calling command comprises a starting floor and a target floor.

23. The elevator-calling control method of claim 21, wherein the displaying includes displaying estimated travel time information of the elevator when the elevator runs from the starting floor to the target floor.

24. The elevator-calling control method of claim 21, wherein the displaying includes displaying attribute information of each elevator.

25. The elevator-calling control method of claim 21, further comprising:

determining, at least based on the elevator-calling command, elevators in the elevator group which are available for the passenger to select and take as the several elevators.

26. The elevator-calling control method of claim 21, wherein the elevator-calling control terminal is a mobile intelligent terminal.

27. The elevator-calling control method of claim 26, wherein the inputting an elevator-calling command, the displaying and the elevator selecting are completed in an area outside an elevator waiting hall of the starting floor.

* * * * *